US009163795B2

(12) United States Patent
Yang

(10) Patent No.: US 9,163,795 B2
(45) Date of Patent: Oct. 20, 2015

(54) CANDLE APPARATUS WITH LIGHT TRANSMISSIVE FIGURES

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 279 days.

(21) Appl. No.: 13/802,824

(22) Filed: Mar. 14, 2013

(65) Prior Publication Data

US 2014/0268709 A1 Sep. 18, 2014

(51) Int. Cl.
*F21V 35/00* (2006.01)
*F21S 6/00* (2006.01)

(52) U.S. Cl.
CPC ..... *F21S 6/001* (2013.01)

(58) Field of Classification Search
CPC ..... F21S 2/00; F21S 6/00; F21S 9/00
USPC ..... 362/190, 392, 806
See application file for complete search history.

(56) References Cited

U.S. PATENT DOCUMENTS 5,678,918 A * 10/1997 Lin ..... 362/96
6,295,749 B1 * 10/2001 Lin ..... 40/406
6,447,138 B1 * 9/2002 Yang ..... 362/96
6,474,858 B1 * 11/2002 Liao ..... 362/551
6,604,835 B2 * 8/2003 Zale ..... 362/101
7,296,906 B1 * 11/2007 Wu ..... 362/119
7,762,682 B2 * 7/2010 Yang ..... 362/155
7,784,959 B2 * 8/2010 Yang ..... 362/101
7,934,845 B2 * 5/2011 Yang ..... 362/101
2008/0151534 A1 * 6/2008 Lin ..... 362/191

* cited by examiner

*Primary Examiner* — Ali Alavi
(74) *Attorney, Agent, or Firm* — Leong C. Lei

(57) ABSTRACT

The present invention provides a candle apparatus with light transmissive figures comprising a base having a power supply unit provided thereon to receive a battery therein and electrically connected thereto to generate a power; a lighting unit provided on a top portion of the base and electrically connected to the power supply unit of the base; a light transmissive housing comprising a decorative figure layer on a housing wall thereof; and a light shield provided to cover a top portion of the housing. Therefore, as the light generated by the lighting unit passes through the housing and shone onto the decorative figure layer, the figures on the decorative figure layer are illuminated to show on the housing such that the candle apparatus of the present invention advantageously offers an illumination with unique visual effects as well as decorative and entertaining lighting.

3 Claims, 4 Drawing Sheets

CANDLE APPARATUS WITH LIGHT TRANSMISSIVE FIGURES

TECHNICAL FIELD OF THE INVENTION

The present invention is related to a candle apparatus, in particular, to an electronic candle.

DESCRIPTION OF THE PRIOR ART

As modern lights and lighting fixtures continues to evolve and develop, the traditional lighting of candles nowadays is being used for decoration purposes in such as special occasions or events while the appearances of candles have always been of column shapes without significant variations. Furthermore, for traditional candles, the candle flame is known to be affected by its surrounding air and wind once lit, which is a concern to users as such flickering of candle flames in windy environment may either be blown off or may cause tipping off of the candle causing the hot candle wax to spill, leading to the occurrence of fire hazards or other dangerous accidents. There is a need for an improved candle apparatus capable of overcoming the drawbacks of the traditional candles.

SUMMARY OF THE INVENTION

Accordingly, the present invention provides a candle apparatus with light transmissive figures comprising:

a base having a power supply unit provided on a lateral side thereof to receive a battery therein and electrically connected thereto to generate a power;

a lighting unit provided on a top portion of the base and electrically connected to the power supply unit of the base; and a light transmissive housing comprising an opening and a decorative figure layer on a housing wall thereof; and wherein the housing covers an outer circumference of the base. Therefore, as the light generated by the lighting unit is shone onto and toward the decorative figure layer and passes through the housing to the exterior thereof, the candle apparatus of the present invention is able to produce a unique atmospheric lighting for decorative purposes and such that a rich and entertaining illumination effects with active and decorative lighting can be advantageously achieved.

DETAILED DESCRIPTION OF THE PREFERRED EMBODIMENTS

Figure 1:
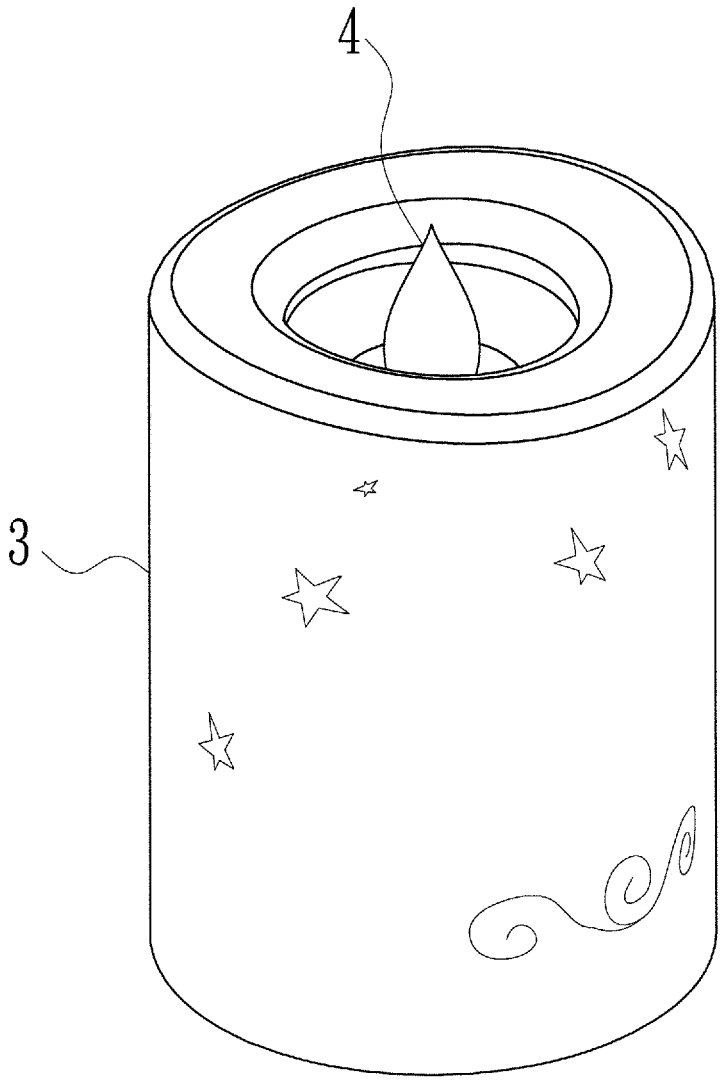
FIG. 1 is a perspective view of the present invention.
Figure 2:
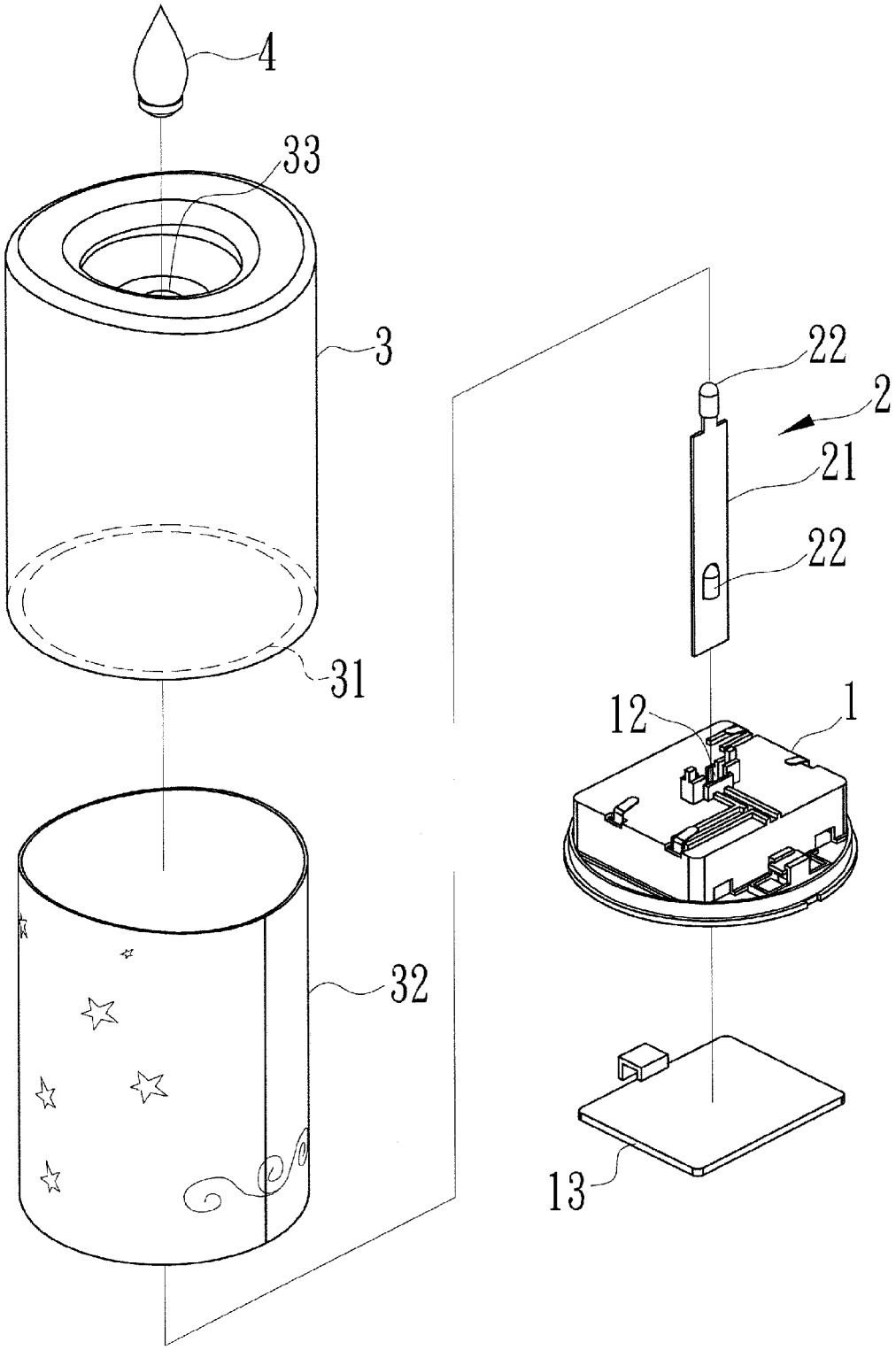
FIG. 2 is an exploded view of the present invention.
Figure 3:
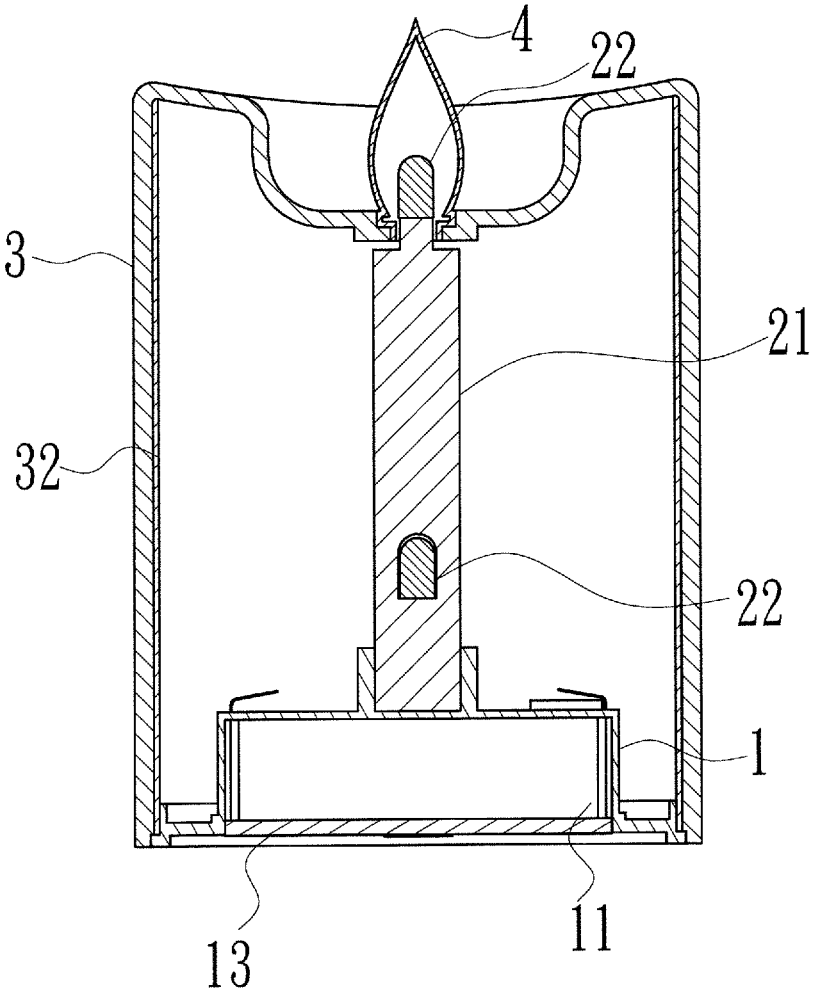
FIG. 3 is a lateral cross sectional view of the present invention.

Please refer to FIG. 1 to FIG. 3, showing a preferred embodiment of a candle apparatus with light transmissive figures of the present invention. As shown in the figure, the candle apparatus with light transmissive figures of the present invention comprises:

a base 1 having a power supply unit 11 provided on a lateral side thereof to receive a battery therein and electrically connected thereto to generate a power; wherein the base 1 further comprises a securement slot 12 on a top portion thereof and a bottom cap 13 attached to a bottom portion of the base 1;

a lighting unit 2 comprising a circuit board 21 inserted into the securement slot 12 and electrically connected to the power supply unit 11 of the base 1; wherein the circuit board 21 comprises at least one lighting element 22 electrically connected thereto; and a light transmissive housing 3 comprising an opening 31 covering an outer circumference of the base 1; wherein the housing 3 comprises a decorative figure layer 32 on a housing wall thereof.

Figure 4:
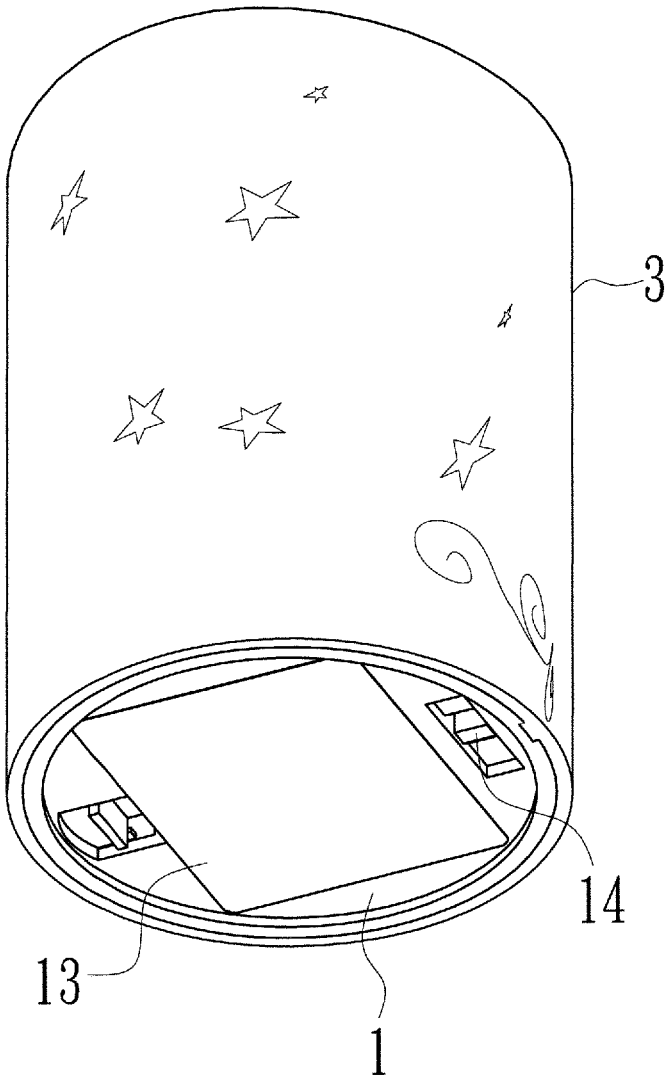
FIG. 4 is a bottom perspective view of the present invention.

As shown in FIG. 4, in an embodiment of the present invention, the base 1 further comprises a switch 14 having one end electrically connected to the power supply unit 11 and another end electrically connected to the circuit board 21. The switch 14 is used for controlling on and off states of the lighting elements 22 of the lighting unit 2 of the lighting unit 2. The top portion of the housing 3 comprises a through-hole 34, and two lighting elements 22 spaced apart from each other are electrically connected to the circuit board 21; wherein one of the lighting elements 22 is provided on a top of the circuit board 21 and is partially exposed from the through-hole 34. The through-hole 34 is configured to receive a light shield 4 arranged thereon; wherein the light shield 4 is of a hollow shape of a candle flame. In this embodiment, the two lighting elements 22 are color LED lights, and the circuit board 21 can be used to control a color changing sequence of the LED lights. In addition, the decorative figure layer 32 is a light transmissive slat attached to an inner side of the housing wall of the housing 3. Therefore, the two lighting elements 22 are able to shine lights onto and toward the decorative figure layer 32 to passing through the housing 3 and the exterior thereof such that a unique atmospheric lighting for decorative purposes can be advantageously achieved.

The decorative figure layer 32 can be provided on the inner side of the housing wall of the housing 3 via a formation method of a vacuum platting by coating an inner layer thereon and followed by laser engraving to form desired figures on the layer in order to obtain the decorative figure layer 32 of the present invention. In view of the above, the candle apparatus with light transmissive figures of the present invention can be advantageously used as a replacement for traditional candles while offering various ways and design possibilities of manipulating and creating desired figures of the decorative figure layer 32 provided thereon such that the candle apparatus with light transmissive figures of the present invention is of the merits of improved illumination effects having a rich and entertaining visual presentation and with active and decorative lighting.

What is claimed is:

1. A candle apparatus with light transmissive figures, comprising:

a base having a power supply unit provided on a lateral side thereof to receive a battery therein and electrically connected thereto to generate a power;

a lighting unit comprising a circuit board mounted to and extending upward from a top portion of said base and having a top end distant from said base, said circuit board being electrically connected to said power supply unit of said base, said circuit board comprising a lighting element electrically connected therewith and mounted thereto at a location between the top end of said circuit board and said base so that said lighting element is spaced vertically from said base; and a light transmissive housing comprising an opening and a decorative figure layer comprising a light transmission slat mounted on an inner side of a housing wall of said light transmissive housing; and wherein said housing covers an outer circumference of said base.

2. The candle apparatus with light transmissive figures according to claim 1, wherein said top portion of said housing comprises a through-hole for receiving a light shield arranged thereon, said circuit board further comprising an additional lighting element mounted to the top end thereof and electrically connected therewith to be located in the through-hole and covered by said light shield.

3. The candle apparatus with light transmissive figures according to claim 1, wherein said base comprises a switch having one end electrically connected to said power supply unit and another end electrically connected to said lighting unit to control on and off states of said lighting unit.

* * * * *